United States Patent [19]

Knapp et al.

[11] Patent Number: 4,877,999

[45] Date of Patent: Oct. 31, 1989

[54] METHOD AND APPARATUS FOR PRODUCING AN HF-INDUCED NOBLE-GAS PLASMA

[75] Inventors: Gunter Knapp; Andreas Schalk, both of Graz, Austria

[73] Assignee: Anton Paar KG, Graz, Austria

[21] Appl. No.: 180,590

[22] Filed: Apr. 7, 1988

Related U.S. Application Data

[63] Continuation of Ser. No. 931,031, Nov. 17, 1986, abandoned.

[30] Foreign Application Priority Data

Nov. 15, 1985 [AT] Austria ..... 3342/85

[51] Int. Cl.[4] ..... H01J 7/24

[52] U.S. Cl. ..... 315/248; 315/111.21; 315/267; 313/231.31; 313/570; 313/607; 313/631; 333/24 C; 333/99 PL

[58] Field of Search ..... 333/24 C, 99 PL, 32; 315/248, 111.1, 111.2, 267; 313/362.1, 231.01, 231.1, 231.3, 570, 574, 607, 631

[56] References Cited

U.S. PATENT DOCUMENTS

| | | | |
|---|---|---|---|
| 2,800,622 | 7/1957 | Lion | 315/248 X |
| 3,525,953 | 8/1970 | Halverson | 333/99 PL X |
| 3,569,777 | 3/1971 | Beaudry | 315/111.21 |
| 3,577,207 | 5/1971 | Kirjushin | 315/39 |
| 3,600,712 | 8/1971 | Williamson | 315/39 X |
| 3,641,389 | 2/1972 | Leidigh | 315/39 |
| 3,671,195 | 6/1972 | Bersin | 313/231.01 X |
| 3,783,419 | 1/1974 | Lafond et al. | 333/24 C X |
| 3,946,272 | 3/1976 | Young | 315/267 |
| 4,115,184 | 9/1978 | Poulsen | 315/111.2 X |
| 4,451,766 | 5/1984 | Angle et al. | 315/248 |
| 4,629,940 | 12/1986 | Gagne et al. | 333/32 X |

*Primary Examiner*—James J. Groody
*Assistant Examiner*—Mark R. Powell
*Attorney, Agent, or Firm*—Bacon & Thomas

[57] ABSTRACT

The invention concerns a method and apparatus to produce a noble-gas plasma for excitation in optical emission spectrometry. The apparatus includes an hf generator feeding an oscillation circuit consisting of at least one inductor and one capacitor. The capcitor includes at least two capacitor plates which are so shaped and mutually arranged that they enclose a cavity in which the plasma may form.

16 Claims, 7 Drawing Sheets

FIG. 15
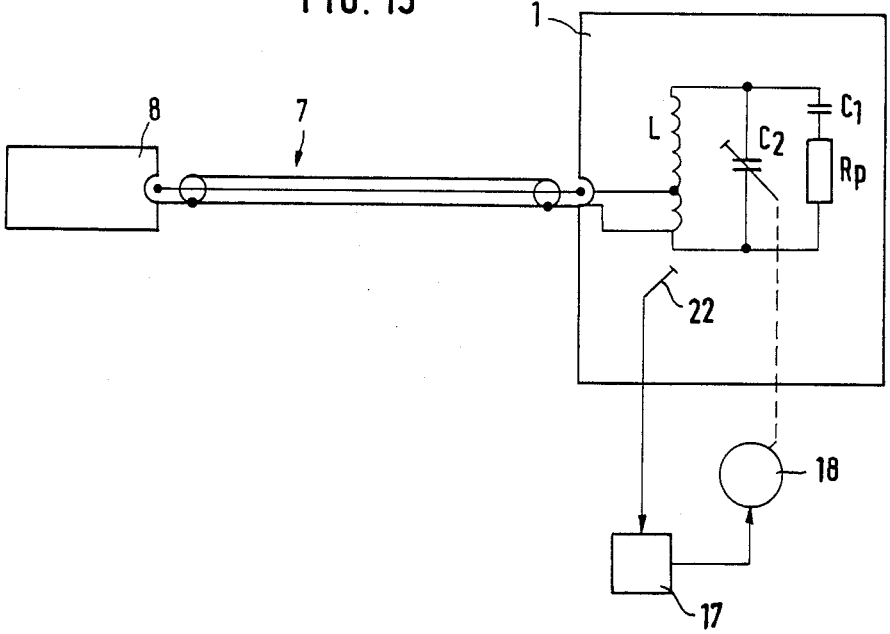
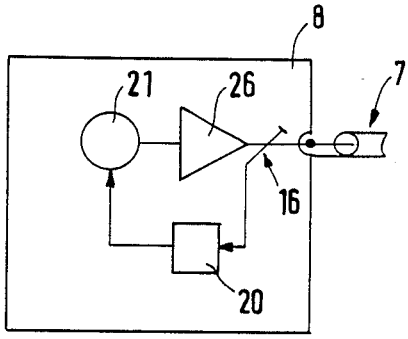
FIG. 16

METHOD AND APPARATUS FOR PRODUCING AN HF-INDUCED NOBLE-GAS PLASMA

This application is a continuation, of application Ser. No. 931,031, filed 11/17/86 now abandoned.

BACKGROUND OF THE INVENTION

1. Field of the Invention.

The invention concerns an apparatus for producing a high-frequency induced noble gas plasma such as is used in particular in excitation in optical emission spectrometry. The excitation means employed is a high-frequency generator.

2. Description of Related Art

The noble gas considered here is helium and/or argon that shall be used at normal (atmospheric) pressure. In recent years such plasmas have assumed high significance as radiation sources in emission spectrometry. Diverse methods are known for producing the plasma. Besides plasma production by means of a DC arc (DCP), the other methods used in particular involve applying to the gas the energy required to produce the plasma in the form of high-frequency electromagnetic oscillations. A problem is incurred thereby expecially when coupling the electromagnetic power into the gas. Illustratively, the operative frequency range from 13 to 100 MHz must be selected for the generally known inductive coupling, and the power applied then is between 500 w and several kw (ICP method). If the coupling is capacitive (CMP method), a high frequency signal at 2,450 MHz is used and the power is 0.5—3 kw. In both cases, the power to be coupled therefore is exceedingly high.

A further method operating at 2,450 MHz is known, where a power of 50–200 w suffices to produce the plasma, however this method (MIP) causes difficulties in obtaining a uniformly arcing plasma when different probes are introduced. In this instance, the plasma tends to form filamentary arcing channels which strongly degrade the measurements (see for instance D. Kollotzek, Spectrochimica Acta, Vol. 37B, #2, pp 91–6, 1982).

The initially cited methods (DC arcs, ICP, CMP) are suitable for comparatively large specimens, but in view of their high performance they are initially costly. Moreover, the consumption of noble gas in such apparatus is between 5 and 20 liter//minute, which entails high operational costs. On the other hand, the above-cited MIP method is comparatively more economical in purchase cost and furthermore requires a lesser consumption of noble gases (less than 1 liter/minute). However, besides the above mentioned difficulties and lack of plasma uniformity, a further problem is encountered, namely that the plasma occasionally extinguishes and always must be re-fired externally by means of primary ions, for instance by an arc discharge.

SUMMARY OF THE INVENTION

In the light of the above state of the art, it is the object of the present invention to create a method and an apparatus whereby it is possible to produce in simple manner an essentially uniformly arcing plasma.

This problem is solved by the invention in that the energy required for firing and maintaining of the plasma is coupled into the gas through two mutually opposite capacitor plates between which the plasma is formed or located, these capacitor plates together with an inductor forming an oscillating circuit and being fed with an hf potential at a frequency corresponding to the resonant frequency of the oscillating circuit. Advantageously, the oscillating circuit shall be driven at a resonant frequency approximately between 10 and 100 MHz.

The method can be carried out by an apparatus which is characterized in that the high frequency (hf) generator of this apparatus is connected to an oscillating circuit which it feeds, this oscillating circuit comprising at least one inductor and at least one capacitor element, this capacitor element including at least two capacitor plates which are so shaped and mutually arranged that they enclose a cavity wherein the plasma can form.

The method and/or the apparatus of the invention assure that essentially the entire energy transmitted into the oscillating circuit shall be transmitted into the gas and after this gas' firing into the plasma because the gas or the plasma in some sense is a component of the energy transmission system. When the cavity between the capacitor plates is suitable shaped, a homogeneous field may be created therein, whereby the plasma arcs uniformly and does not form channel-filaments. Contrary to the case for the above cited CMP and MIP methods, the method and/or apparatus of the invention allow using excitation frequencies that are lower by one or two orders of magnitude than in the conventional case.

Advantageously a tube (illustratively, 6 mm in diameter with a wall thickness of 1–1½ mm) is made of an electrically non-conducting and high-temperature resistant material such as quartz, or quartz glass, aluminum oxide or boron nitrite and is mounted in such a manner between the capacitor plates that it encloses the cavity (less the wall thickness). Thereby the capacitor plates are separated from the gas or plasma and the gas can be fed in a simple manner to the cavity between the capacitor components. To prevent overheating resulting from extended operation of the capacitor plates, cooling means, in particular water cooling elements, are provided in the capacitor plates.

The apparatus can be manufactured in expecially simple manner if the cavity is essentially cylindrical, the generated electric field then being very homogeneous in this cavity. In other preferred embodiments of the invention, the tube is flattened, being cylindrical with illustratively an elliptical cross-section, the homogeneous region of the field being enlarged thereby and the feed of aerosol being facilitated. The term "flattened" or "cylindrically flattened" means a tube of which two mutually opposite and axially extending sidewalls are flattened or pressed flat.

In a preferred embodiment of the invention, at least one of the capacitor plates is provided with an aperture directed essentially toward the center of the cavity whereby plasma radiation can pass through this aperture to be analyzed outside the apparatus. In this way it is possible to utilize both the radiation emitted from the apparatus along the tube axis (together with the gas) and also the radiation portion emitted by the plasma in the other directions. Such a system illustratively may be operated in a closed circuit after a specimen has been inserted into the noble gas and the spectroscopic test results can be determined over a substantial length of time, whereby on one hand the gas consumption is minimized and the signal-to-noise ratio of the test results is increased, and on the other hand, the required amount of specimen is lowered.

In an especially preferred embodiment of the invention, at least one of the components forming the oscillating circuit includes means to tune its impedance. In this manner, the oscillating circuit—of which the resonant frequency is basically determined by the geometric and electrical properties of the cavity (for instance its filler material—can be tuned to a predetermined supply frequency of the hf-generator. Illustratively this will be required when the hf generator must operate at officially prescribed frequencies or when it must operate at a frequency set by the design (resonance amplifier). In such a case, the oscillating circuit advantageously includes an adjustable capacitor in series or preferably in parallel with the capacitor component. Such tunable capacitors are commercially available and accordingly the apparatus design is substantially simplified and made cheaper.

If the osciallating circuit is a series or parallel circuit, then an increased hf voltage is set up between the capacitor plates, resulting in plasma firing. Accordingly, no separate energy of firing need be applied after the hf generator is turned on, rather the plasma is self-firing.

It is especially advantageous in the above embodiment, wherein the oscillation circuit is tunable, that the impedance tuning means be remote controlled. In such a case the oscillation circuit can be tuned automatically.

In a preferred embodidment of the invention, the impedance tuning means then include a test circuit to measure the power damping of the oscillation circuit and further a regulation circuit connected to the test circuit and so designed and so connected to a setting member acting on the impedance tuning means that the oscillation circuit is automatically tuned to the supply frequency of the hf generator. This automatic tuning assures that following changes within the apparatus, for instance when changing the tube or the like, the apparatus after being switched on will automatically adjust itself to the resonant frequency of the oscillation circuit. Also during operation the changes in the electrical conditions (resonant frequency) are automatically compensated.

In a preferred embodiment of the invention, adjustment means are so arranged in the hf generator that the output frequency of the hf generator can assume three different and essentially constant values. In that case the regulating and test circuits are so connected to the adjustment means that the setting member tunes the oscillation circuit to a higher resonant frequency when the power in the oscillation circuit at the highest frequency is higher, and the power at the lowest frequency is lower than the power in the oscillation circuit at the center frequency. In the reverse case, that is when the power in the oscillation circuit at the lowest frequency is higher, and the power at the highest frequency is lower than the power at the center frequency, the oscillation circuit is moved to a lower resonant frequency. When the frequency spacings between the lowest and center or between the center and the highest frequency are equal (logarithmically), no change in the resonant frequency of the oscillation circuit is undertaken if the highest and lowest supply frequency of the hf generator cause the same test result for the damping/power measurement. In that case the center frequency will be precisely at the resonant frequency of the oscillating circuit. Therefore in this preferred embodiment of the invention, the hf generator is driven at three fixed frequencies, the center frequency being the actual operational one while the two other frequencies diverging from it are merely used as test frequencies. Accordingly, the test frequencies need be present only temporarily, and the regulating circuit is designed to be of corresponding inertia. This is very easily done because system changes take place only very slowly or take place mainly when the apparatus is turned on. This self-regulating system is especially advantageous when the hf generator must be operated, on the grounds already discussed above, at a fixed frequency.

In another preferred embodiment of the present invention, the hf generator includes an internal regulating circuit designed in such a manner that the generator output frequency is automatically set to that value at which maximum power is accepted by the oscillation circuit. In this case, therefore, the oscillation circuit is not tuned, instead the generator output frequency is tuned (within a predetermined range) to the arbitrary resonant frequency of the oscillation circuit.

As regards all the above stated embodiments of the present invention, advantageously the hf generator will include a voltage-controlled oscillator as the oscillating element. Such voltage-controlled oscillators are commercially available and by means of slight circuitry modification can be designed to form highly frequency-stable generators, and furthermore, no phase jumps will occur if there is switching between various frequencies.

It is especially advantageous for the above stated systems that a sensor be mounted near the inductor to measure the magnetic field generated by this inductor and make it available as an (electrical) output signal. In this case, the sensor in no way affects the system consisting of generator and oscillation circuit and delivers a signal that is substantially proportional to the power in the oscillation circuit. A coil or a Hall element or the like is especially well suited as such a sensor.

In a further preferred embodiment of the invention, the hf generator includes a power regulating circuit designed and connected in such a manner with the sensor that the output power of the hf generator is kept at a preselected value. Obviously, the sensor also can be mounted directly in the output line of the hf generator. Such a power-regulated system allows to keep the power constant in the plasma with other conditions, for instance gas supply, being kept constant.

Advantageously the supply connected from the hf generator to the oscillation circuit is implemented by means of at least one coil tap of the inductor. In this manner it is possible to use a generator with standard output impedance (for instance 50 ohms) and with a correspondingly standard transmission cable as well as the conventional connector materials (BNC cables and connectors) and to achieve nevertheless relatively reflection-free coupling to the oscillation circuit. As there may be nevertheless reflections in the cable at different plasma impedances and hence voltage shifts (interference radiation), advantageously the feed connection shall be balanced. In that case, the reflections only occur at the inner conductors of the (double conductor, shielded) cable and are substantially self-compensated.

BRIEF DESCRIPTION OF THE DRAWINGS

FIG. 15 is a further preferred embodiment of the invention with automatic frequency tuning; and FIG. 16 is a preferred embodiment of a power-regulated hf generator.

DETAILED DESCRIPTION OF THE PREFERRED EMBODIMENTS

Figure 1:
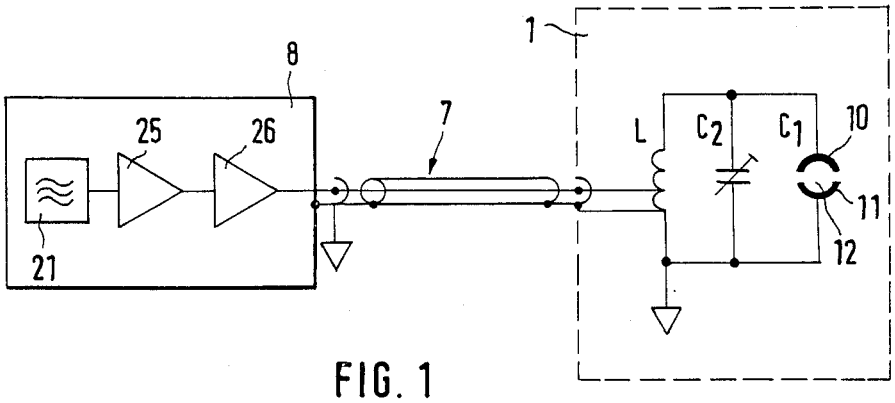
FIG. 1 shows the circuit diagram of a first, preferred embodiment of the invention with unbalanced coupling.

The basic design of the apparatus is described below in closer detail in relation to FIG. 1. As shown by FIG. 1, a hf generator 8 consisting of an oscillator 21, a pre-amplifier 25 and a power amplifier 26 is connected by a cable 7 to an oscillation circuit 1. The oscillation circuit 1 consists of an inductor L to the tap of which is applied the signal, and of a variable capacitor $C_2$ parallel to the inductor L. Two capacitor plates 10,11 are connected in parallel to the two components and together bound a cavity 12. The capacitor plates 10 and 11 form the capacitor $C_1$. By feeding an hf signal to the oscillation circuit 1, an electrical field is generated between the capacitor plates 10 and 11, that is in the cavity 12, whereby the gas contained in the cavity 12 can be heated into the plasma state.

Figure 2:
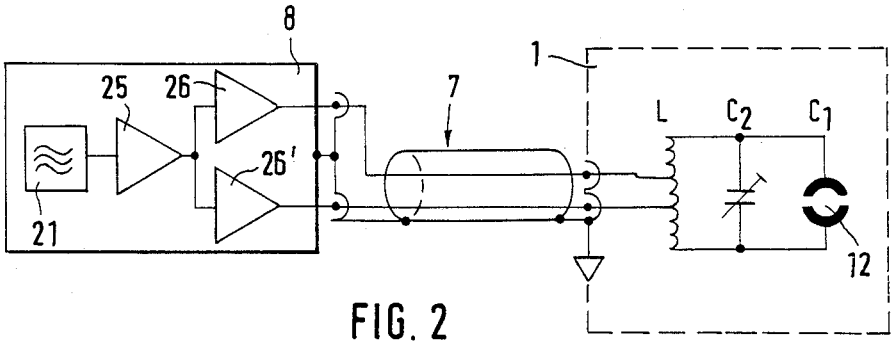
FIG. 2 shows a circuit diagram similar to FIG. 1 but with balanced coupling.

In the embodiment of the invention shown in FIG. 2, the hf generator 8 consists of an oscillator 21 followed by a pre-amplifier 25, the pre-amplifier feeding two power amplifiers 26,26' in a push-pull. The outputs of the power amplifiers 26,26' are applied to a balanced line 7 coupled through balanced taps of the coil L to the oscillation circuit 1. In this design the reflections caused by mismatching the oscillation circuit 1 to the wave impedance of the cable 7 or of the generator 8 are reduced.

The mechanical design of the apparatus of the invention is discussed below in relation to an illustrative embodiment (FIGS. 3 through 6). This discussion in particular concerns the design of the capacitor $C_1$. As shown by the FIGS. 3 through 6, the capacitor $C_1$ is formed by two condensor plates 10,11 which are held in place by means of the arms of a capacitor base 4. The capacitor plates 10,11 are supplied by (omitted) ducts with cooling water and are cooled. The capacitor plates are shaped in the manner of the stator of an electric motor so that they define between them an essentially annular space. This annular space is bounded by a tube 13 on which the capacitor plates 10,11 rest in essentially hermetic manner.

Figure 3:
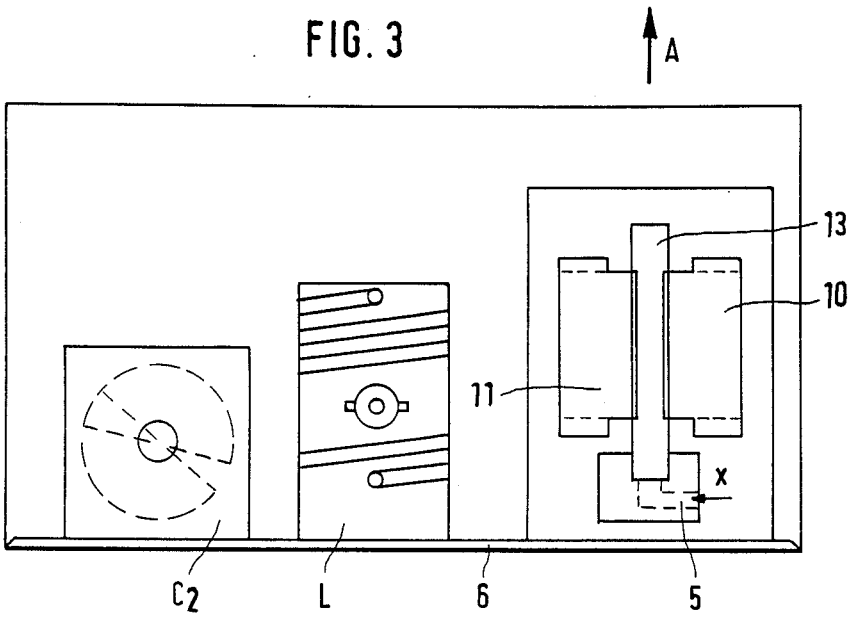
FIG. 3 is a schematic side view of an embodiment of the invention.
Figure 4:
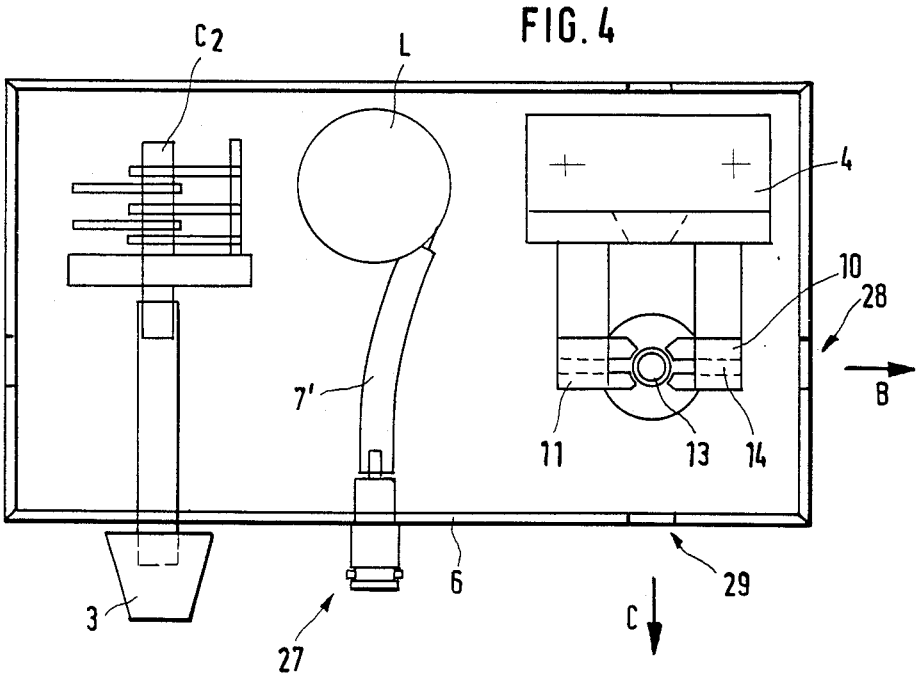
FIG. 4 is a top view of the apparatus of FIG. 3.
Figure 5:
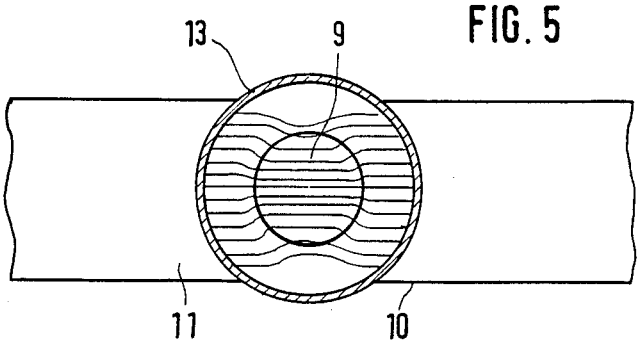
FIG. 5 is a cut-away top view of a capacitor with a tube located between the plates.
Figure 6:
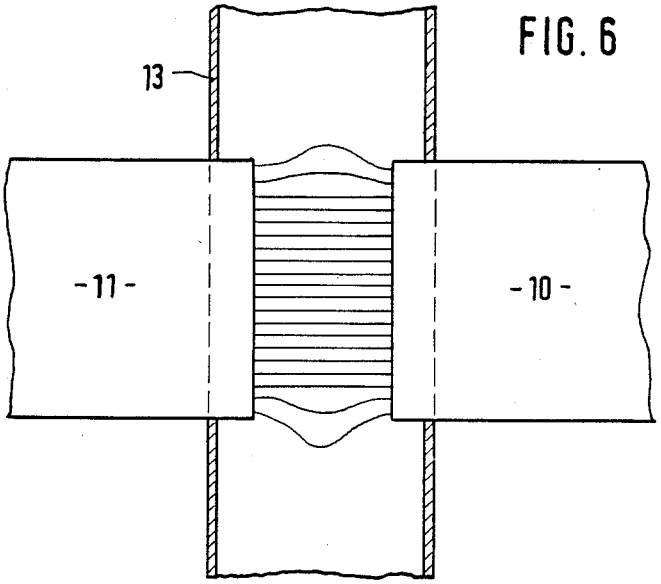
FIG. 6 is a side view of the apparatus of FIG. 5.

A generator 8 and its output cable 7 with a corresponding connector is coupled by means of the BNC jack 27 to the apparatus shown in FIGS. 3 and 4 in such a manner that the signal is fed through a further cable segment 7' to the coil L. The oscillation circuit is tuned by means of the rotary knob 3 of the capacitor $C_2$ in such a manner that its resonant frequency coincides with the supply frequency. If the gas from a supply conduit 5 (FIG. 3) is made to pass through the tube 13, then it will be heated by the electrical field between the capacitor plates 10,11. If a plasma 9 is formed in the tube 11, then in principle the field lines shown in FIGS. 5 and 6 will be set up. This field within the plasma 9 is essentially homogeneous and accordingly the plasma "fires" uniformly. The radiation (of a specimen in the firing gas helium-argon) excited in the plasma together with the gas leaves the tube 13 in the direction of the arrow A, arriving therefore in the direction of the tube axis in the free space, where by means of a suitable detector it can be converted into an electrical signal and be processed further.

Figure 7:
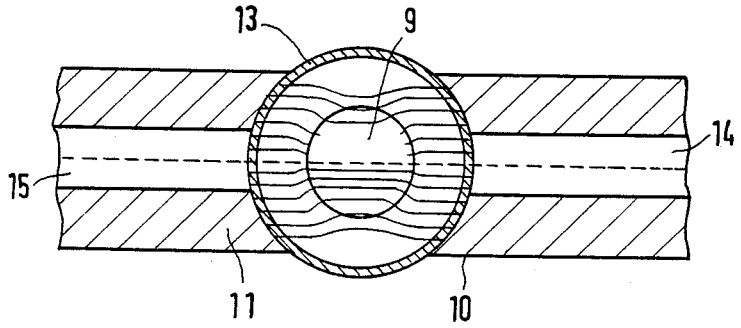
FIG. 7 is a sectional view of apparatus similar to that of FIG. 5 but provided with apertures in the capacitor plates.
Figure 8:
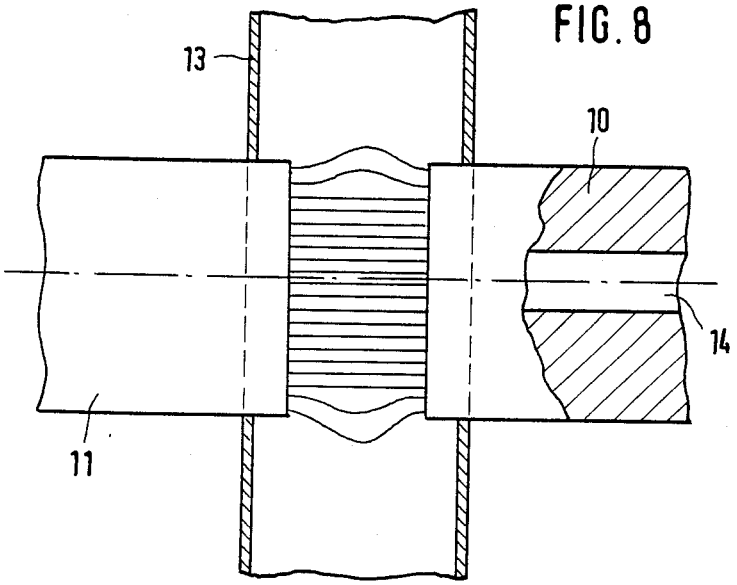
FIG. 8 is a partly sectional side view of the apparatus of FIG. 7.

In a preferred embodiment of the invention shown in closer detail in FIGS. 7 and 8, the capacitor plates 10,11 are provided with apertures or boreholes 14,15 located essentially centrally in the capacitor plates 10,11. The radiation also can be emitted through these boreholes 14,15 in the direction of the arrow B (FIG. 4) and thus leave the apparatus. Moreover, the radiation can be emitted from the apparatus in the direction of the arrow C, that is between the two capacitor plates 10,11. Obviously, this is only the case if the material of the tube 13 is of a suitable nature (for instance, quartz glass).

Figure 9:
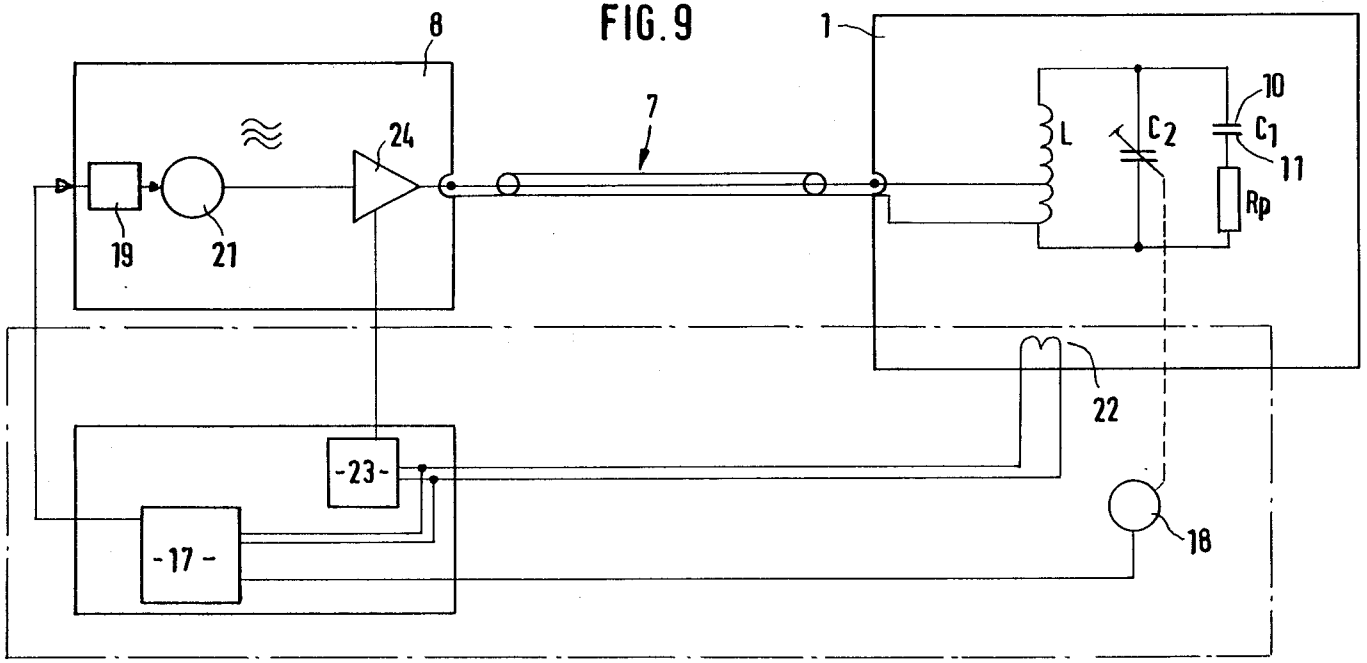
FIG. 9 is a first preferred embodiment of the invention with a regulating circuit.

A preferred embodiment of the invention with regulation is described below in greater detail in relation to FIG. 9. As shown by FIG. 9, the hf generator 8 includes a voltage controlled oscillator (VCO) 21 of which the output signal is amplified by a power amplifier 24. The gain of the amplifier 24 is adjustable (VGC) by means of a control line. As already described in relation to FIGS. 1 through 4, the oscillation circuit 1 comprises a variable capacitor $C_2$. In this case, however, the capacitor $C_2$ is adjusted by a setting member 18, for instance a servomotor in response to an electrical signal. The servomotor 18 is connected to the output of a regulating circuit 17. A sensor 22 is mounted next to the inductor L and picks up the intensity of the magnetic field generated by the coil L which it then feeds in the form of an electrical signal both to the regulating circuit 17 and to a power regulating circuit 23. Another output of the regulating circuit 17 is connected to an adjustment circuit 19 in the generator 8 which in relation to the received input signals from the regulating circuit 17 makes available three different (precise) voltage values to the voltage controlled oscillator 21.

The design of the power regulating circuit 23 is such that when the field intensity generated by the coil L differs from a nominal value, the gain of the amplifier 24 increases, while in the reverse case it is decreased. In this manner, the power fed into the oscillation circuit 1 can be kept constant.

Figure 11:
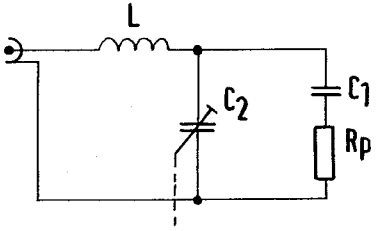
FIGS. 10 and 11 are two preferred embodiments of tuned oscillation circuits.
Figure 10:
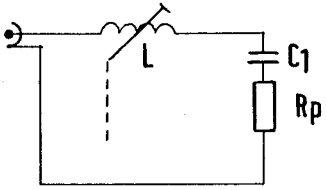
Figure 13:
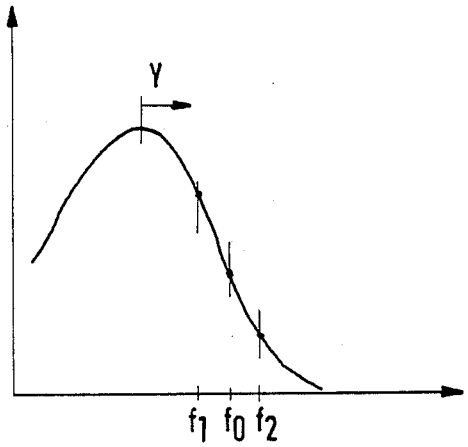
Figure 14:
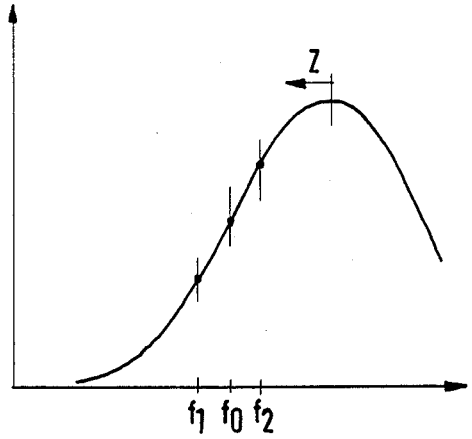

The system frequency tuning is described in further detail below in relation to FIGS. 12 through 14, independently of the oscillation circuit 1 designed as shown in FIG. 9 or designed as shown by FIGS. 10 and 11 as a series oscillation circuit with either tuning inductor (FIG. 10) or capacitor (FIG. 11).

Figure 12:
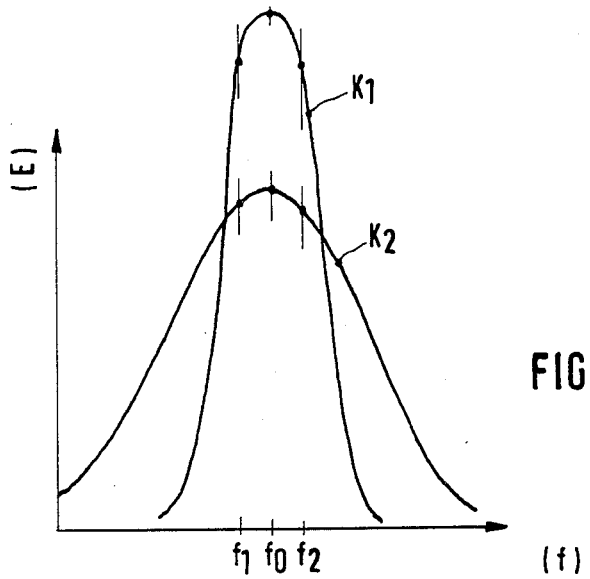
FIGS. 12 through 14 are plots of frequency vs. field intensity of the apparatus of the invention in various operational modes.

In FIG. 12, the curve $K_1$ denotes the field intensity (as a function of frequency) before the plasma has fired, the curve $K_2$ denotes the field intensity when the plasma already has fired. Thus, this plot shows that by lowering the resistance $R_P$ representing the effective cavity resistance, the system is damped. The system resonant frequency changes only slightly after the plasma fires. The regulation takes place as follows: the oscillator 21 is alternatingly supplied with three different voltages by the adjustment means 19 so that its output frequency corresponds to the frequencies $f_0$, $f_1$ and $f_2$; when the oscillation circuit 1 is precisely tuned to the center frequency $f_0$ (about 10–100 MHz) of the generator 8, the positions of the three frequencies shown in FIG. 12 are obtained. On the other hand, if, as shown by FIG. 13, the oscillation circuit is tuned to a resonant frequency which is too low, then the curve of FIG. 13 is obtained. This curve shows that the field intensity is highest at the lowest oscillator frequency $f_1$, but is lowest at the highest oscillator frequency $f_2$. Such conditions are communicated by the sensor 22 to the regulating circuit 17, whereupon same so controls the setting member 18 that the capacitance of the capacitor $C_2$ is lowered, hence the curve of FIG. 13 is shifted in the direction of the arrow Y toward higher values. In the reverse case shown in FIG. 14, the setting member 18 is driven into the opposite direction. Obviously, the "test frequencies" $f_1$, $f_2$ need be fed only intermittently to the system to achieve essentially proper tuning of the frequency. In particular, the system must be tuned when being turned on, when possibly the generator 8 or the output amplifier 24 is operated at low power insufficient for firing the plasma as the system resonant frequency—in the manner already discussed above—does not significantly change (see FIG. 12). The supply voltage for the capacitor plates is approximately 1–3 kv.

Alternatively, the generator 8 need not be controlled, but the oscillation circuit 1 is tuned in some other manner. As shown by FIG. 15, a sensor 22 may be provided in the oscillation circuit 1, for instance a magnetic field pickup near the coil L. The output signal from the sensor 22 then is fed to a regulator 17 of which the output is connected to a setting member 18 tuning the capacitor $C_2$. In this embodiment of the invention, the reference value fed to the regulator is set between three different values (in relation to the fixed output frequency of the generator 8) as already explained in relation to FIGS. 12 through 14. The test results are used similarly to the case of the previous embodiment to adjust the capacitor $C_2$. In this case, therefore, there is no switching of the generator output frequency, rather the oscillation circuit 1 is tuned to three different frequencies until its center frequency corresponds to the generator output frequency.

A further preferred embodiment for frequency tuning the generator 8 is shown in FIG. 16. In this case, the output power from the generator 8 is detected by a sensor 16 and fed to the input of a regulator 20. The output of the regulator 20 is connected to the control input of the VCO 21 of which the output is connected to the input of the power amplifier 26. Similar to the regulator 17, the regulator 20 includes a subsequent adjustment means 19. But the essential difference with respect to the circuit of FIG. 9 is that instead of the resonant frequency of the oscillation circuit 1, it is the center frequency $f_0$ together with the two different frequencies $f_1$ and $f_2$ which are shifted for tuning.

The principles, preferred embodiments and modes of operation of the present invention have been described in the foregoing specification. The invention which is intended to be protected herein should not, however, be construed as limited to the particular forms described, as these are to be regarded as illustrative rather than restrictive. Variations and changes may be made by those skilled in the art without departing from the spirit of the invention. Accordingly, the foregoing detailed description should be considered exemplary in nature and not as limiting to the scope and spirit of the invention set forth in the appended claims.

We claim:

1. An apparatus for producing an HF-induced noble gas plasma, comprising:
   an HF generator for generating a high frequency output signal; and
   an oscillation circuit including an inductor and at least one primary capacitor, said oscillation circuit receiving said high frequency output signal, and said primary capacitor comprising at least two capacitor plates positioned with respect to one another so as to define a cavity therebetween through which a noble gas flows at substantially atmospheric pressure.

2. An apparatus as claimed in claim 1, further comprising a tube formed from an electrically non-conductive material said tube positioned in the cavity defined by the capacitor plates.

3. An apparatus as claimed in claim 1, wherein said capacitor plates define a cylindrical cavity.

4. An apparatus as claimed in claim 1, wherein at least one of said capacitor plates comprises an aperture substantially directed at the center of said cavity so as to permit radiation to exit from said cavity defined by said plates.

5. An apparatus as claimed in claim 1, wherein said primary capacitor discharges during an increase in the hf voltage between said capacitor plates.

6. An apparatus as claimed in claim 1, further comprising means for tuning the impedance of said oscillation circuit.

7. An apparatus as claimed in claim 4, wherein said oscillation circuit further comprises an adjustable capacitor in a parallel circuit with said primary capacitor.

8. An apparatus as claimed in claim 4, wherein said means for impedance tuning is remote controlled.

9. An apparatus as claimed in claim 8, wherein said means for impedance tuning comprises:
   a test circuit for measuring power damping in said oscillation circuit; and
   a regulation circuit connected to said oscillation circuit for actuating said impedance tuning means so as to automatically tune the supply frequency of said hf generator.

10. An apparatus as claimed in claim 8, wherein:
   said impedance tuning means comprise means for producing three distinct, constant frequency values ($f_1$, $f_0$, $f_2$); and
   a test regulation circuit for tuning said oscillation circuit to a higher resonance frequency if the power in the oscillation circuit at the highest frequency ($f_2$) is greater than the power in the oscillation circuit at the center frequency ($f_0$) which is greater than the power in said oscillation circuit at the lowest frequency ($f_1$), said test regulation circuit tuning said oscillation circuit to a lower resonant frequency if the power in the highest resonant frequency ($f_2$) is less than the power in the center resonance frequency ($f_0$) which is less than the power in the lowest resonance frequency ($f_2$).

11. An electric apparatus as claimed in claim 1, wherein said hf generator comprises an internal regulation circuit that adjusts said hf generator so that said output frequency has a center frequency ($f_0$) at which said oscillation circuit accepts maximum power.

12. An apparatus as claimed in claim 1, wherein said hf generator comprises a voltage-controlled oscillator.

13. An apparatus as claimed in claim 9, further comprising a sensor positioned near said inductor to produce a signal proportional to the magnetic field produced by said inductor.

14. An apparatus as claimed in claim 13, wherein said hf generator comprises a power regulating circuit connected to said sensor to maintain the output power contained in said output signal from said hf generator at a predetermined value.

15. An apparatus as claimed in claim 1, wherein:

said inductor comprises at least one coil tap; and said high frequency output signal of said hf generator is supplied to said oscillation circuit through said at least one coil tap of said inductor.

16. An apparatus as claimed in claim 1, wherein said output signal of said hf generator is balanced with said oscillation circuit.

* * * * *